United States Patent [19]

Bass et al.

[11] Patent Number: 5,066,254

[45] Date of Patent: Nov. 19, 1991

[54] BOAT PROPELLER GUARD

[76] Inventors: Joseph D. Bass, 4119 N. Citrus Ave., Crystal River, Fla. 32629; Leroy H. Steinhilber, 5849 W. Tirana La., Dunnellon, Fla. 32630

[21] Appl. No.: 478,444

[22] Filed: Feb. 12, 1990

[51] Int. Cl.[5] ..... B63H 5/16

[52] U.S. Cl. ..... 440/72; 416/247 A

[58] Field of Search ..... 440/71, 72; 416/247 R, 416/247 A

[56] References Cited

U.S. PATENT DOCUMENTS

| | | | |
|---|---|---|---|
| 2,916,010 | 12/1959 | Dimmer | 416/247 A |
| 2,983,246 | 5/1961 | Manley | 440/72 |
| 4,680,017 | 7/1987 | Eller | 440/72 |

*Primary Examiner*—Jesus D. Sotelo
*Attorney, Agent, or Firm*—Walter J. Monacelli

[57] ABSTRACT

The propellor guard described herein is designed primarily for the protection of manatee but is also useful in protection against injury to other animals and larger fish which might come in contact with a boat's propellor. This guard is tapered toward substantially a point at the front end and is substantially circular at the rear end so as to encircle the region in which the propellor is rotated. The guard has a V-bracket at the front which is securely pressed against a propellor support and is supported at the rear in the circular portion by a pair of clamps which engage and are bolted tightly onto the cavitation plate.

9 Claims, 2 Drawing Sheets

BOAT PROPELLER GUARD

BACKGROUND OF THE INVENTION

1. Field of the Invention

This invention relates to a specifically designed guard for a boat propellor aimed to protect against damage to various objects that might otherwise come in contact with the propellor. More specifically this guard relates to one comprising a set of bars shaped and spaced to embrace the propellor while allowing free flow of water through the guard but capable of warding off objects, particularly live objects, from coming in contact with the propellor blades.

2. State of the Prior Art

There are a number of patents disclosing various devices for protecting boat propellors. These include U.S. Pat. Nos. 2,319,640; 2,963,000; 3,035,538; and 4,680,017 as well as German Pat. No. 3,727,322, French Pat. No. 1,289,967 and Swedish Pat. No. 146,029.

However none of these patents disclose or suggest applicants' design which allows free flow of water therethrough and permitting easy and secure fastening of the guard to the propellor supports.

Propellor guards are particularly important for the protection of slow moving animals such as manatee which live in shallow tropical waters and are becoming an endangered species. However such guards are also useful for protecting humans and other live objects as well as to protect the propellor against injury by impact with large objects.

OBJECTIVES

It is an object of this invention to provide a guard for a boat propellor which will not retard or interfere with the free flow of water to and from the propellor.

It is also an object of this invention to provide protection against injury to live as well as inanimate objects.

It is also an object of this invention to provide protection to the propellor blades from injury by contact with large objects.

It is also an object of this invention to provide a guard which can be easily and securely fastened to the propellor support.

Other objects will become obvious upon reading the detailed description of the invention as given hereinafter.

SUMMARY OF THE INVENTION

In accordance with the present invention, a propellor guard has been designed which meets all of the above objectives. This guard is assembled from a set of metal rods, preferably of stainless steel, which are welded together and shaped to encircle the propellor. The front end of the guard is tapered substantially to a point so as to shunt and turn away objects which come into the path of the propellor. The rear part of the guard is circular and large enough to encircle the propellor blades. The front part of the guard has a V-shaped bracket which is pressure fitted against a portion of the support for the propellor. The upper part of the rear circular portion of the guard is open and provided with two brackets, each having an opening therein so that when the brackets are fitted onto two sides of the cavitation plate, a bolt through the two openings may be tightened to provide a tight grasp of the brackets onto the cavitation plate thus providing a secure attachment of the guard onto the cavitation plate and also securing a tight fit of the V-shaped bracket at the front of the guard against the support for the propellor.

The novel design of this invention may be illustrated by reference to the accompanying drawings in which.

Figure 1:
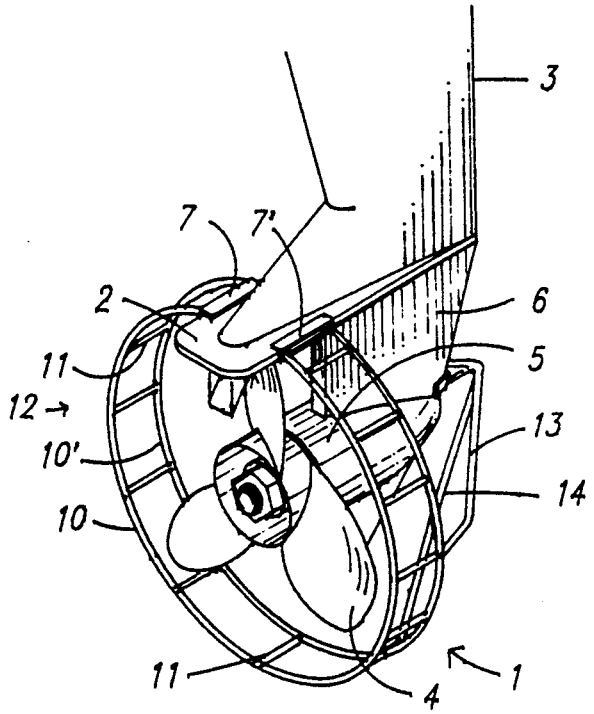
FIG. 1 is a perspective view of the propellor guard of this invention shown attached to the lower part of a boat motor.
Figure 2:
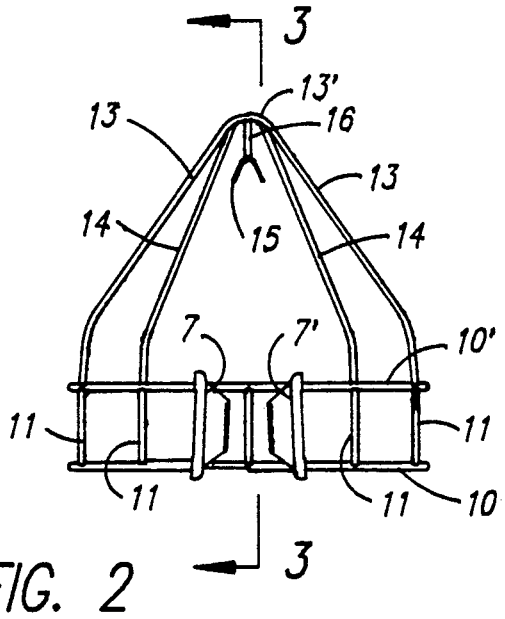
FIG. 2 is a top plan view of the propellor guard of FIG. 1.
Figure 3:
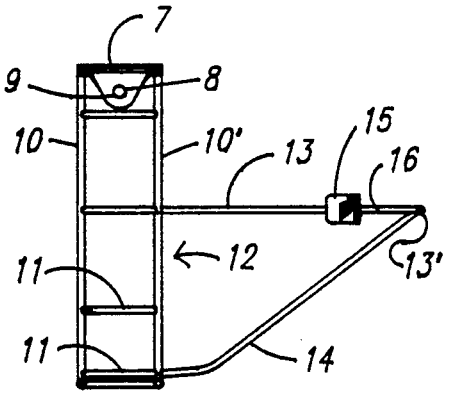
FIG. 3 is a side elevational cross-sectional view taken at lines 3—3 of FIG. 2.

More specifically propellor guard 1 slides onto and is held onto the cavitation plate 2 of the lower part 3 of the motor (not completely shown) so as to completely surround propellor 4 which is rotated by rotor 5 which rotor is held by support 6 extending downward from lower part 3 of the motor. Brackets 7 and 7' engage and are held onto cavitation plate 2 by means of bolt 8 extending through openings 9 in the brackets 7 and 7'. Brackets 7 and 7' each comprise a flat portion designed to lay flat on the cavitation plate 2 and a flap extending downward from the flat portion, in which flap portion opening 9 is positioned. Circular rods 10 and 10' are connected by bridging rods 11 to form a frame 12 which surrounds and guards the propellor 4. Circular rods 10 and 10' each have an open section, the two open sections being opposite to each other. Bracket 7 is attached to one pair of adjacent ends of the circular bars at the open section and bracket 7' is attached to the other pair of adjacent ends of the circular bars. The brackets are preferably welded to the said ends of the circular bars. Horizontal rod 13 and angle rod 14 extend from frame 12 to brace the V-bracket 15 against support 6. V-bracket 15 is attached to and supported by rod 16 which is attached to and extends interiorly from curved portion 13' of rod 13. It is contemplated that various modifications of the V-bracket may be used, such as a U-bracket or a small plate with a notch or slot cut in one side thereof. The main requirement is that the bracket can catch onto a portion of support 6 or an equivalent part to brace and hold the nose or front portion of the guard.

Figure 4:
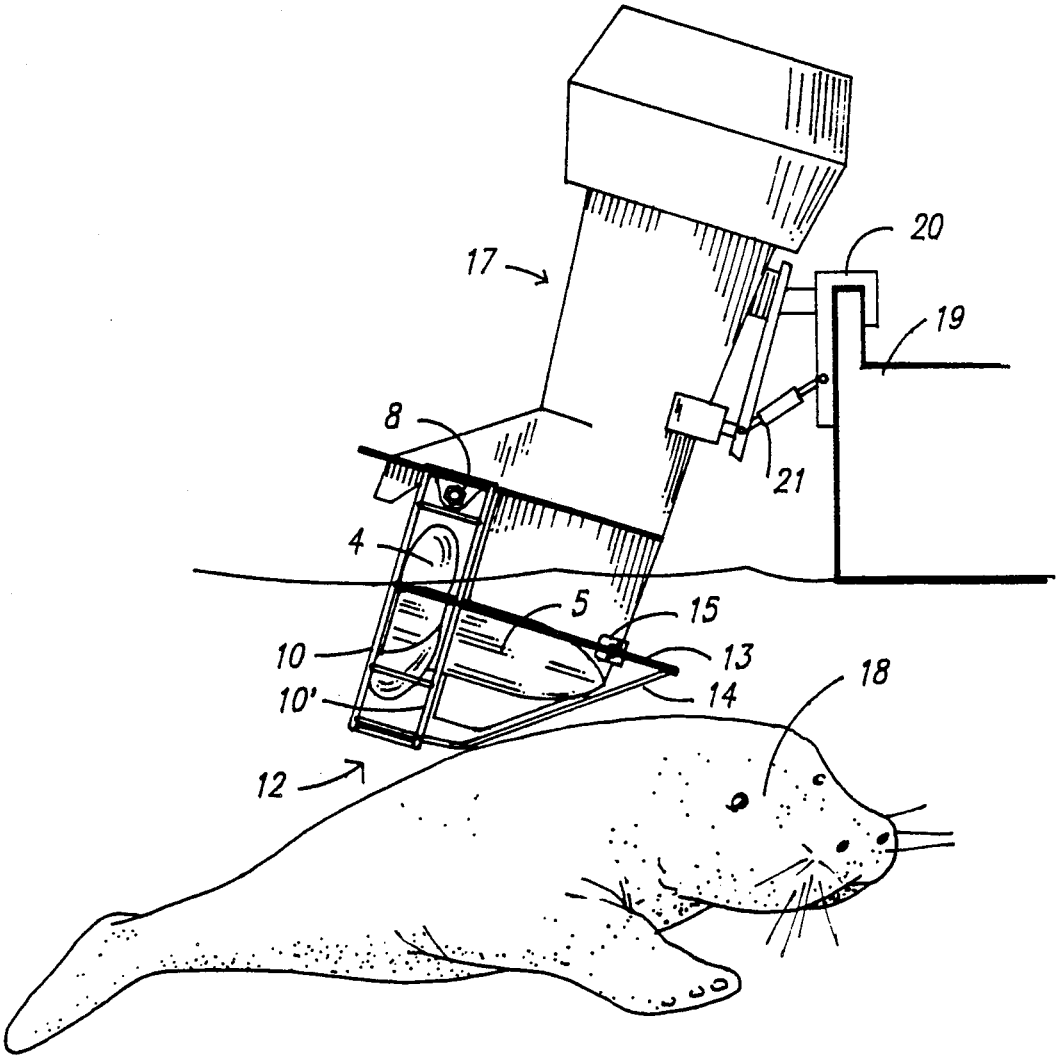
FIG. 4 is a side elevational view of the assembly of the propellor guard on a boat motor and the manner by which a manatee or other object may be protected by the propellor guard.

FIG. 4 shows how motor 17 is tilted when guard frame 12 comes in contact with a manatee 18 or other object. The motor 17 is attached to and supported on boat 19 by bracket 20. The connection to the boat is advantageously of a swivel type which will permit the motor to be tilted when the protective frame 12 comes in contact with an object. The degree of tilting is limited by spring 21 which, together with the force of gravity and thrust of the propellor, returns the motor to its normal position when the frame 12 is freed from contact with the object.

The tapered nose of the propellor guard is designed to shunt objects out of the path of the propellor. As previously indicated, the guard is very easily fastened to the propellor support by means of a bolt through the brackets on the circular portion of the guard. If desired, more than one bolt may be used for this purpose but one bolt is generally sufficient and facilitates quick fastening to the cavitation plate. Moreover the V-shaped bracket at the nose of the guard aids in the fast and secure fastening of the front end of the guard to the propellor support.

In addition to the protection provided by the guard against striking objects another advantage is that the propellor may be driven through seaweeds in shallow water without having the propellor tangled therein. The shape and structure of the guard facilitates pushing the weeds aside so that the propellor may be pushed through.

The bars described herein are preferably made of stainless steel in order to withstand corrosion, particularly when the boat is being used in salt water. However other materials may be used such as other types of steel, aluminum, anodized aluminum, etc. In such latter cases the bars are advantageously coated with a protective coating, preferably of plastic.

While certain features of this invention have been described in detail with respect to various embodiments thereof, it will of course be apparent that other modifications can be made within the spirit and scope of this invention, and it is not intended to limit the invention to the exact details insofar as they are defined in the following claims.

The invention claimed is:

1. A boat propellor guard comprising:

(a) a circular section made from two metal bars shaped into two circles each having a diameter at least slightly larger than the diameter of the circle travelled by the tips of the propellor blades, said two circular bars being spaced from and substantially parallel to each other and joined by a plurality of spacer bars spaced from each other and connected to said circular bars, each of said circular bars having an open section therein with the two said open sections being opposite to each other;

(b) a first and a second bracket means, the first bracket means attached to one pair of the ends of said circular bars at one side of said open section and the second bracket means being attached to the other pair of ends of circular bars at the said open section, said bracket means being capable of securing said guard to the cavitation plate of a boat propellor, each of said bracket means having an opening therein:

(c) a bolt and nut adapted to fit into said bracket means openings and to press said bracket means toward each other and to lock onto said cavitation plate when said nut is tightened on said bolt;

(d) at least two bars spaced from each other and joined to and extending from one of said circular bars, said bars bending inwardly to meet each other a substantial distance from the circular bar to which they are attached, the said bars being attached to said circular bar at a substantial distance from the open section in said circular bar, the arrangement of said bars extending from said circular bar having a general conical configuration; and (e) a third bracket means positioned near the apex of said conical configuration and supported by one of said bars in said conical configuration, said third bracket means being adapted to become tightly secured against a supporting section for said propellor;

in which in said first and second bracket means each bracket means comprises a flat portion adapted to lay flat on said cavitation plate and a flap extending at an angle downward from said flat portion, said flap having at least one opening therein capable of having a bolt passed therethrough; said third bracket means comprising a single flat piece bent into a V-shaped bracket capable of being pressed against and maintaining secure contact against a supporting section for said propellor; said V-shaped bracket being attached to and extending inwardly from said general conical configuration toward said supporting section for said propellor.

2. The propellor guard of claim 1 in which each of said bars extending from one of said circular bars is bent at the apex of said conical configuration and each of said bent bars is turned back to and joined at the other end of said bar to the said circular bar.

3. The propellor guard of claim 2 in which each of said bars is made of stainless steel.

4. The propellor guard of claim 2 in which each of said bars is made of steel coated with a protective plastic coating.

5. The propellor guard of claim 2 in which each of said bars is made of aluminum.

6. The propellor guard of claim 5 in which each of said aluminum bars is coated with a protective plastic coating.

7. The propellor guard of claim 2 in which each of said bars is made of anodized aluminum.

8. The propellor guard of claim 1 in which each of said bars is made of stainless steel.

9. The propellor guard of claim 2 in which each of said bars is made of steel coated with a protective plastic coating.

* * * * *